US008053964B2

(12) United States Patent
Maul et al.

(10) Patent No.: US 8,053,964 B2
(45) Date of Patent: Nov. 8, 2011

(54) SPARK PLUG WITH INCREASED PRESSURE RESISTANCE

(75) Inventors: Georg Maul, Bad Wildbad (DE); Dieter Kuhnert, Sinsheim (DE)

(73) Assignee: Multitorch GmbH, Sinsheim (DE)

( * ) Notice: Subject to any disclaimer, the term of this patent is extended or adjusted under 35 U.S.C. 154(b) by 363 days.

(21) Appl. No.: 12/310,905

(22) PCT Filed: Aug. 13, 2007

(86) PCT No.: PCT/EP2007/007127

§ 371 (c)(1),
(2), (4) Date: Mar. 12, 2009

(87) PCT Pub. No.: WO2008/031482

PCT Pub. Date: Mar. 20, 2008

(65) Prior Publication Data

US 2010/0001626 A1 Jan. 7, 2010

(30) Foreign Application Priority Data

Sep. 16, 2006 (DE) ..... 10 2006 043 593

(51) Int. Cl.
*F02M 57/06* (2006.01)
*H01T 13/02* (2006.01)

(52) U.S. Cl. ..... 313/120; 313/135; 313/143

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 1,754,796 | A * | 4/1930 | McElroy | 313/141 |
| 2,632,132 | A | 3/1953 | Delano | |
| 2,962,543 | A | 11/1960 | Candelise | |
| 3,431,450 | A * | 3/1969 | Errico | 313/125 |
| 4,029,990 | A | 6/1977 | Nagy et al. | |
| 4,412,151 | A * | 10/1983 | Norris | 315/55 |
| 4,850,316 | A * | 7/1989 | Pasbrig | 123/154 |
| 5,283,134 | A * | 2/1994 | Sugimoto et al. | 428/698 |
| 5,554,908 | A * | 9/1996 | Kuhnert et al. | 313/140 |
| 6,170,451 | B1 * | 1/2001 | Moriya | 123/169 PA |
| 6,510,728 | B2 * | 1/2003 | Matsuo et al. | 73/31.05 |
| 6,559,577 | B2 * | 5/2003 | Okazaki et al. | 313/118 |
| 6,992,426 | B2 | 1/2006 | Francesconi et al. | |
| 7,243,643 | B2 * | 7/2007 | Iwami et al. | 123/635 |
| 2002/0195917 | A1 * | 12/2002 | Hiramatsu | 313/144 |
| 2004/0070323 | A1 * | 4/2004 | Francesconi et al. | 313/140 |
| 2005/0174026 | A1 * | 8/2005 | Egger et al. | 313/144 |
| 2007/0069617 | A1 * | 3/2007 | Tozzi et al. | 313/140 |
| 2007/0119409 | A1 * | 5/2007 | Johng et al. | 123/267 |
| 2007/0236122 | A1 * | 10/2007 | Borror | 313/118 |

FOREIGN PATENT DOCUMENTS

| | | | |
|---|---|---|---|
| DE | 195 00 216 | A1 | 7/1996 |
| DE | 10 2004 046 895 | A1 | 3/2006 |
| WO | WO 03/071644 | A1 | 8/2003 |

* cited by examiner

*Primary Examiner* — Nimeshkumar Patel
*Assistant Examiner* — Jose M Diaz

(57) ABSTRACT

The invention relates to a spark plug for igniting a combustible gas mixture in an internal combustion engine, comprising an ignition electrode (4), an electrical supply line (5), to which the ignition electrode (4) is connected, an insulator body (6), through which the supply line (5) is passed, a housing head (2), which rests in sealing fashion on the insulator body (6) and bears an outer thread (3) for the purpose of screwing it into an internal combustion engine, a tube housing (9), which is fixed on the housing head (2), surrounds the insulator body (6) and has a hexagon head (13). The invention provides that the tube housing (9) surrounds an insulator body holder (7), which is welded to the housing head (2) and presses the insulator body (6) with a prestress against the housing head (2).

19 Claims, 1 Drawing Sheet

SPARK PLUG WITH INCREASED PRESSURE RESISTANCE

The invention relates to a spark plug for igniting a combustible gas mixture in an internal combustion engine, comprising an ignition electrode, an electrical supply line connected to the ignition electrode, an insulator body through which the supply line runs, a housing head that sits tightly on the insulator body, and an outer thread for screwing it into an internal combustion engine. Such a spark plug is disclosed by, e.g., EP 1 265 328 B1.

In internal combustion engines peak pressures in the range of 150 bars can occur. In operation, these peak pressures exert a load on the spark plug which can cause combustion gases to leak from the engine despite true to size manufacturing and thorough sealing. In particular in the case of gas engines peak pressures can cause the insulator body to be pressed out and ejected from the spark plug barrel in an explosive manner.

In order to improve the resistance to pressure and to prevent the insulator body to be pressed out, it was suggested in EP 1 265 328 B1 to mount the insulator body between the housing head and the tube housing as well as to weld the housing head to the tube housing. In such a manner, the pressing out of the insulator body can be effectively met while obtaining an improved sealing.

The object of the invention is to increase the working life and the operating reliability of a spark plug of above-mentioned type.

According to the invention, this object is attained by a spark plug with the features set forth in claim 1.

While the tube housing of the spark plug known from EP 1 265 328 B1 has, on the one hand, the function to protect the spark plug against damages from external effects as well as to transfer a torque for the screwing in of the spark plug and, on the other hand, to clamp the insulator, this clamping function is carried out in a spark plug according to the invention by a insulator body holder that presses the insulator body with a prestress against the housing head. In such a manner the tube housing and the insulator body holder of a spark plug according to the invention can be separately optimized with respect to their pertinent functions. Therefore, the hexagon of the tube housing of a spark plug according to the invention can transfer very high torques to screw the spark plug into an engine block without impairing the sealing between the insulator body and the housing head. Preferably, the tube housing and the insulator body holder are manufactured out of different materials.

Especially with known prechamber spark plugs for gas engines generally long maintenance and replacement intervals cause the problem that, because of dirt accumulation and corrosion of the thread surface, extra high torques are necessary to change a spark plug of an engine. Therefore, very high loads must be transferred via the spark plug housing, which in the case of known spark plugs can cause a defective spark plug to break during changing, which greatly complicates changing of a spark plug. In the case of a spark plug according to the invention, the housing can be optimized independently of the insulator body holder, thus greatly reducing the danger of breaking.

The insulator body holder of a spark plug according to the invention is manufactured preferably out of a metallic material having a thermal expansion coefficient $\alpha_M$, which in the temperature range of 0° C. to 400° C. fulfills with the thermal expansion coefficient $\alpha_K$ of the insulator body the inequation $\alpha_M-\alpha_K<1\cdot10^{-6}$/K. Thus, the thermal expansion coefficient $\alpha_M$ of the insulator body holder is lower than the thermal expansion coefficient $\alpha_K$ of the insulator body or surpasses it by less than $1\cdot10^{-6}$/K. In such a manner, the prestress by means of which the insulator body is tightly pressed against the housing head is maintained to the greatest possible extent even with a heating of a spark plug during operation. Even at increased temperatures it is thus ensured that the housing head rests in insulating fashion on the insulator body.

Within the scope of the invention it was found that, during operation, the insulator body of a spark plug and the metal components surrounding it can heat up to 400° C. and higher. The customary steels used in prior art have a thermal expansion coefficient in the relevant temperature range of about $12\cdot10^{-6}$/K to $15\cdot10^{-6}$/K while the temperature coefficient of the insulator body, typically manufactured out of aluminum oxide, is of about $3\cdot10^{-6}$/K to $8\cdot10^{-6}$/K. In the case of spark plugs of prior art this causes at elevated temperatures, the contact pressure that presses the insulator body against the housing head to abate so that, through a gap between the housing head and the insulator body, gases from the combustion chamber can leak into the plug. Such leakage gases give rise to sediments inside the spark plug, increase the risk of shunts and, in the course of time, can impair the operability of a spark plug and cause its premature failure.

In a spark plug according to the invention, the materials of the insulator body and of the insulator body holder are adapted to each other with respect to the thermal expansion coefficients, so that a better sealing can be lastingly obtained. Therefore, impairments due to leakage gases can be prevented for spark plugs according to the invention. This results in a longer service life. The insulator body can be manufactured out of a ceramic material used in prior art such as, e.g., aluminum oxide, or, in particular, also out of aluminum nitride, that has an advantageously high thermal expansion coefficient. Especially nickel-iron alloys with a nickel content of 25% to 50% per weight have thereto appropriate expansion coefficients. Steel such as, e.g., ST37 steel, is preferred as material for the tube housing.

Preferably, the insulator body holder is welded to the housing head by means of a butt seam or a V-seam. The butt seam welding is especially preferred. Sometimes, fillet welds are also called V-seams and butt seams are called I-seams. Especially when the insulator body holder and the housing head overlap, a highly precise manufacture can be achieved by means of a V-seam or a butt seam.

The welding is preferably done by arc welding, particularly preferred as inert gas shielded arc welding, in particular as TIG welding (tungsten inert gas). In the case of arc welding, the material around the weld seam is strongly heated. Thus, subsequent cooling causes a longitudinal contraction by means of which the insulator body is forcefully clamped between the housing head and the insulator body holder. Thus, the longitudinal contraction caused by the welding brings about a greater contact pressure by means of which the insulator body is pressed against the housing head and, consequently, also a better sealing against the penetration of gases from the combustion chamber of the engine.

EP 1 265 328 B1 discloses the use of laser welding processes for the manufacture of spark plugs. Laser welding has the advantage of a very high precision. Therefore laser welding appears to be particularly suitable for a highly precise manufacture as required for spark plugs. Surprisingly however, it is possible to manufacture spark plugs by means of arc welding that provide an improved sealing between insulator body and housing head. This improved sealing is caused by the contraction taking place during the cooling of the weld seam.

The measure according to the invention to press the insulator body by means of an insulator body holder welded to it against the housing head and to provide a vent hole in the tube housing prevents in a simple and reliable manner that spark plug components are ejected from the tube housing at dangerous peak pressures. Should such high peak pressures occur that, in spite of the welding of the insulator body holder to the housing head, the insulator body is pressed into the tube housing, the pressure can be released by one or several vent holes in the lateral surface of the tube housing without giving rise to a dangerous acceleration of the insulator body and its ejection.

Within the scope of the invention it was found that even with true to size manufacturing and careful sealing slight amounts of exhaust gases can seep even during regular engine operation as leakage gases from, e.g., sealing points between an insulator body and an electrode connection (center electrode) running through it, into the interior of a spark plug surrounded by tube housing. Such leakage gases which, to a greater or lesser extent, are always unavoidable increase the risk of shunts and can therefore impair spark plugs. Leakage gases can e.g., also result in a pressure build up in the tube housing which can lead to a fracturing of insulation layers and thus to a premature failure of the spark plug. By means of a ventilation channel according to the invention it is possible to convey leakage gases out of the tube housing. In such a manner it is possible to prevent damaging effects of leakage gases and consequently to increase the service life of a spark plug.

BRIEF DESCRIPTION OF THE DRAWINGS

Further details and advantages of the invention are hereinafter explained by using an embodiment and making reference to the hereto attached drawing. The described features can be used either separately or in combination in order to create advantageous embodiments of the invention. Herein

DETAILED DESCRIPTION

Figure 1:
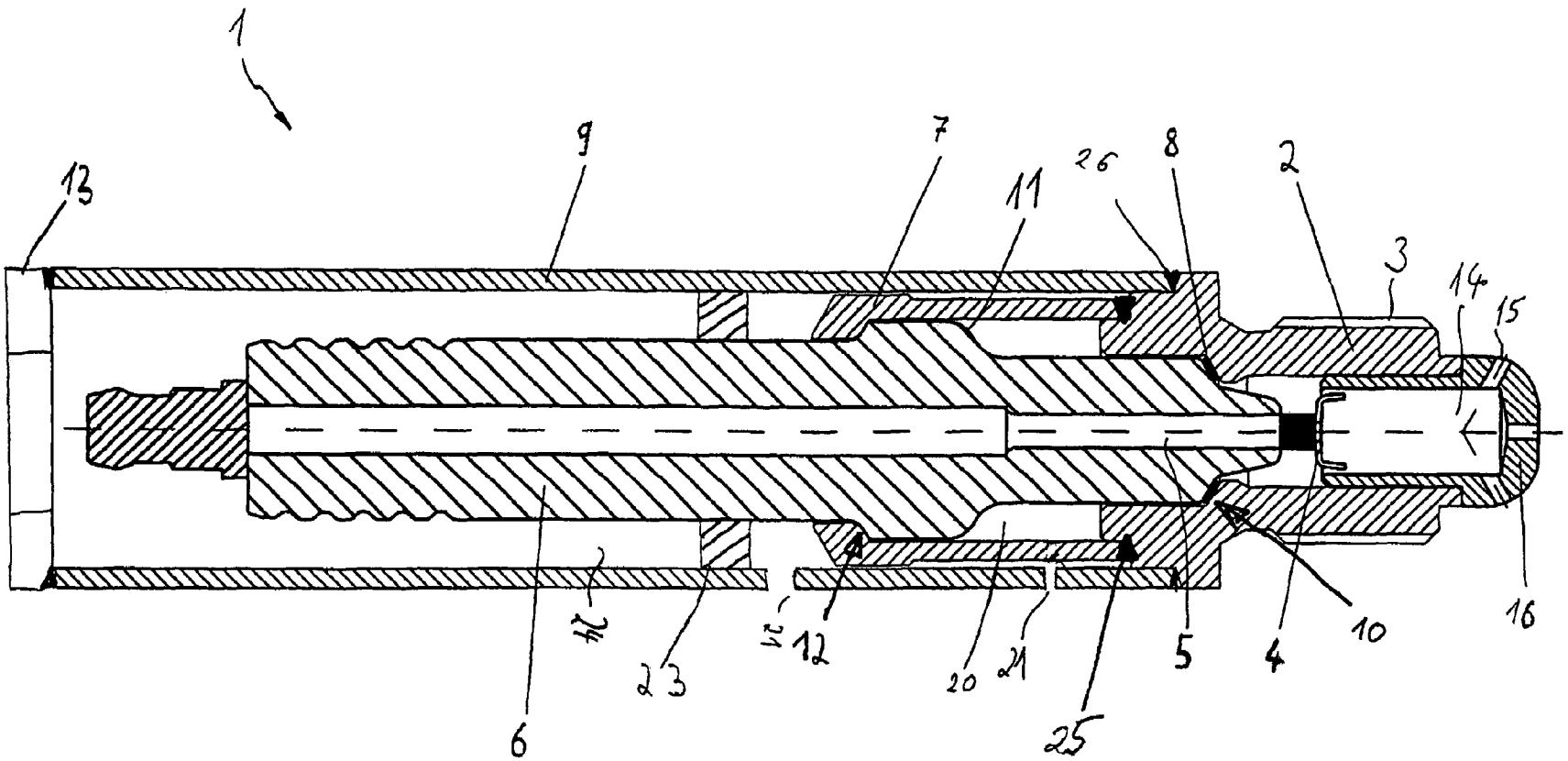
FIG. 1 shows a longitudinal section of a spark plug in accordance with the invention.

The spark plug 1 illustrated in FIG. 1 comprises a housing head 2 with an external thread 3 for screwing it into an internal combustion engine and an ignition electrode 4, that is mounted in the housing head 2. The ignition electrode 4 is connected to an electrical supply line 5 that is also called a center electrode. The supply line 5 is passed through an insulator body 6 that is pressed with a prestress by an insulator body holder 7 against the housing head 2. The housing head 2 sits tightly on the insulator body 6 with a gasket 8 in the form of a copper sealing ring between them. The insulator body holder 7 and the insulator body 6 are surrounded by a tube housing 9 that is fastened by welding to the housing head 2 and has a hexagon head 13 by means of which torque can be transferred which is required for the screwing in of the spark plug 1 into an internal combustion engine. The hexagon 13 is welded to the tube housing 9. The insulator body holder 7 comprises an annular chamber 20 that surrounds the insulator body 6 and is filled with a filling material to carry off of generated heat.

The filling material comprises ceramic powder or it can even consist entirely out of ceramic powder. The ceramic powder can be mixed with a binding agent and/or a heat conducting admixture, preferably in the form of a metal powder, such as, e.g., copper. Preferably, the filling material consists of at least 50% of weight, of especially preferred of at least 75% of weight, particularly preferred of at least 90% of weight ceramic powder such as, e.g., aluminum oxide and/or aluminum nitride. Especially aluminum nitride has the advantage of a good thermal conductivity.

The insulator body 6 has an annular bulge that is encompassed by the insulator body holder 7. Thus, the insulator body holder presses against an annular surface 12 of the insulator body 6 exerting thereby the prestress on the insulator body 6, by means of which the insulator body 6 is pressed against the gasket 8 and the annular surface 10 of the housing head 2. The insulator body holder 7 is welded to the housing head 2. As shown in FIG. 1, the insulator body holder 7 and the housing head 2 are arranged overlapping in a subsection in which there is also the weld seam 25 joining the housing head 2 to the insulator body holder 7. In a corresponding manner, the tube housing 9 and the housing head 2 are also arranged overlapping in a subsection, in which there is also a weld seam 26 joining the tube housing 9 and the housing head 2.

The housing head 2 has a first cylinder surface on which the insulator body holder 7 and a second cylinder surface on which the tube housing 9 rests. By slipping the insulator body holder 7 onto the first cylinder surface and the tube housing 9 onto the second cylinder surface, respectively, an exact positioning is possible with simple means. Each of the two cylinder surfaces is delimited by a shoulder against whose annular surface abut the insulator body holder 7 and the tube housing 9, respectively. The gap between the annular surface of the housing head 2 and the therein abutting end of the insulator body holder 7 and the tube housing 9, respectively, is filled by weld seam 25 and 26, respectively, upon welding.

The weld seams 25, 26 are butt seams that were generated by arc welding, namely TIG welding. During the cooling of the weld seams 25, 26, the material contracts so that the insulator body 6 is pressed by the insulator body holder 7 against the housing head 2. This leads to an improved sealing.

The insulator body 6 is made out of a ceramic material such as, e.g. aluminum oxide or aluminum nitride, which in the temperature range from 0° C. to 400° C. has an expansion coefficient between $4\cdot10^{-6}$/K and $8\cdot10^{-6}$/K. In addition to technically pure aluminum oxide or aluminum nitride it is also possible to use compound ceramics such as, e.g., ceramic materials that contain at least 50% of weight, especially at least 75% of weight, aluminum nitride. The insulator body holder 7 is made out of a metallic material whose thermal expansion $\alpha_M$ surpasses the thermal expansion coefficient $\alpha_K$ of the insulator body 6 in the relevant temperature range of 0° C. to 400° C. at the most by $1\cdot10^{-6}$/K, preferably at the most by $5\cdot10^{-7}$/K, or it is somewhat lower. It is especially advantageous if the thermal expansion coefficient $\alpha_M$ of the insulator body holder 7 is somewhat lower than the thermal expansion coefficient $\alpha_K$ of the insulator body 6 because then a heating-up gives rise to an increased prestress and thus to a still better sealing. Therefore, the thermal expansion coefficient $\alpha_M$ of the metallic material of the insulator body holder 7 is preferably chosen in such a manner that, at a heating-up from 20° C. to 400° C., the metallic material expands less than the ceramic material of the insulator body 6 at a heating-up from 20° C. to 400° C. It is especially advantageous if in the temperature range of 0° C. to 400° C. the total thermal expansion of the material of the insulator body holder 7 does not amount to more than $3\cdot10^{-3}$, especially not more than $2.5\cdot10^{-3}$.

In the illustrated embodiment, the metallic material of the insulator body holder 7 is a nickel-iron alloy with a nickel content of 25% of weight to 50% of weight. Suitable nickel-iron alloys are offered by the Deutsche Nickel AG under the designations Dilaton 36, Dilaton 42 and Dilaton 48. Especially suitable are in particular Dilaton 36, whose thermal expansion coefficient amounts to only about $5.5\cdot10^{-6}$/K in the temperature range of 0° C. to 400° C., as well as Dilaton 42 whose thermal expansion coefficient amounts to only about $6 \cdot 10^{-6}$/K in the temperature range of 0° C. to 400° C.

In view of the different functions of the insulator body holder 7 and the tube housing 9 it is advantageous to manufacture them out of different metallic materials. By way of example, the tube housing 9 is made out of standard steel, e.g., ST37 steel.

The illustrated spark plug 1 is a prechamber spark plug because the ignition electrode 4 is arranged in a prechamber 14 that can enter into connection via openings 15 with the combustion chamber of an internal combustion engine (not shown). By way of example, prechamber spark plugs are known from EP 0 675 272 A1 to which reference is made with respect to details and characteristics of prechamber spark plugs. In the illustrated embodiment, the prechamber 14 is configured by a cap 16 that is inserted into the housing head 2. Nickel is especially appropriate as material for the cap 16 while the rest of the housing head 2 with the external thread 3 is made out of steel, especially ST52-3 or S355 steel.

Should in spite of all the described measures a leakage of gases occur, the tube housing 9 is provided on its lateral surface with vents 21 for venting leakage gases. Although in principle, corresponding vents 22 can also be provided in the insulator body holder 7, leakage gases inside the annular space 20 are much less problematic since the annular space 20 does not contain any components to which voltage is applied. Consequently there is no risk of shunts. On the other hand, leakage gases are particularly damaging in the area in which the supply line 5 (center electrode) leaves the ceramic body 6 and where, by way of example, it is connected to a strand of a cable, because sediments in that area increase the risk of shunts.

A penetration of leakage gases into the rear area (that is to say, opposite to the head 2) in which the supply line 5 leaves the ceramic body 6 is counteracted by a seal 23. In the herein illustrated embodiment this seal 23 is a sealing ring that encompasses the part of the insulator body 6 protruding from the insulator body holder 7. In the illustrated embodiment the seal 23 is a plastic ring such as, e.g., a Teflon ring. Any leakage gases that might seep out of the annular space 20 between the insulator body holder 7 and the insulator body 6 abutting the annular surface 12 are impeded to advance farther and discharged by means of the vent holes 21 from the tube housing.

REFERENCE NUMBERS

1. Spark plug
2. Housing head
3. Outer thread
4. Ignition electrode
5. Supply line (center electrode)
6. Insulator body
7. Insulator body holder
8. Gasket
9. Tube housing
10. Annular bulge of the insulator body
11. Annular bulge of the insulator body
12. Annular surface
13. Hexagon
14. Prechamber
15. Prechamber opening
16. Cap
20. Annular space
21. Vent
23. Seal
24. Annular space
25. Weld seam
26. Weld seam

What is claimed is:

1. A spark plug for igniting a combustible gas mixture in an internal combustion engine, comprising
an ignition electrode,
an electrical supply line to which the ignition electrode is connected,
an insulator body through which the supply line is passed,
a housing head that rests in sealing fashion on the insulator body and bears an outer thread for the purpose of screwing it into an internal combustion engine,
a tube housing that is fixed on the housing head, surrounds the insulator body and has a hexagon head, said tube housing having at least one vent hole,
wherein
the tube housing surrounds an insulator body holder that is welded to the housing head and presses the insulator body with a prestress against the housing head.

2. A spark plug according to claim 1, wherein the insulator body holder is welded to the housing head by a weld seam which is either a butt seam or a V-seam.

3. A spark plug according to claim 1, wherein insulator body holder is welded to the housing head by an arc welding seam.

4. A spark plug according to claim 1, wherein the tube housing is welded to the housing head.

5. A spark plug according to claim 1, wherein the insulator body is surrounded by a seal.

6. A spark plug according to claim 5, wherein seen from the housing head, the seal is mounted behind the at least one vent hole.

7. A spark plug for igniting a combustible gas mixture in an internal combustion engine, comprising
an ignition electrode,
an electrical supply line to which the ignition electrode is connected,
an insulator body through which the supply line is passed, the insulator body being made out of a metallic material having a thermal expansion coefficient $\alpha_M$ that fulfills in the temperature range of 0° C. to 400° C. with the thermal expansion coefficient $\alpha_K$ of the insulator body the inequation $\alpha_M - \alpha_K < 1 \cdot 10^{-6}$/K,
a housing head that rests in sealing fashion on the insulator body and bears an outer thread for the purpose of screwing it into an internal combustion engine,
a tube housing that is fixed on the housing head, surrounds the insulator body and has a hexagon head,
wherein
the tube housing surrounds an insulator body holder that is welded to the housing head and presses the insulator body with a prestress against the housing head.

8. A spark plug according to claim 7, wherein the thermal expansion coefficient $\alpha_M$ of the metallic material of the insulator body holder is chosen in such a manner that, at a heating up from 20° C. to 400° C., the metallic material expands less than the ceramic material of the insulator body at a heating up from 20° C. to 400° C.

9. A spark plug according to claim 1, wherein the insulator body holder comprises an annular space that surrounds the insulator body and is filled with a filling material comprising at least 50% of weight of ceramic powder.

10. A spark plug according to claim 1, wherein between the housing head and the insulator body is a gasket.

11. Spark plug according to claim 10, wherein the gasket is a copper gasket.

12. A spark plug according to claim 1, wherein the insulator body holder is manufactured out of a different material than the tube housing.

13. A spark plug according to claim 1, wherein the insulator body holder presses against an annular surface of the insulator body.

14. A spark plug according to claim 1, wherein the insulator body holder and the housing head are overlapping.

15. A spark plug according to claim 1, wherein the tube housing and the housing head are overlapping.

16. A spark plug according to claim 15, wherein the insulator body holder and the housing head overlap on a cylindrical surface.

17. A spark plug according to claim 16, wherein the housing head has a first cylinder surface on which the insulator body holder rests and a second cylinder surface on which the tube housing rests.

18. A spark plug according to claim 1, wherein the housing head forms a prechamber in which the ignition electrode is arranged.

19. A spark plug according to claim 1, wherein the insulator body consists of at last 50% of weight of aluminum nitride.

* * * * *